US007983605B2

(12) United States Patent
Nakamura et al.

(10) Patent No.: US 7,983,605 B2
(45) Date of Patent: Jul. 19, 2011

(54) DEVELOPING MEMBER WITH URETHANE RESIN AND SILICONE SURFACE LAYER

(75) Inventors: Minoru Nakamura, Suntoh-gun (JP); Ryota Kashiwabara, Mishima (JP); Atsushi Tanaka, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 216 days.

(21) Appl. No.: 11/845,489

(22) Filed: Aug. 27, 2007

(65) Prior Publication Data

US 2008/0069600 A1 Mar. 20, 2008

(30) Foreign Application Priority Data

Sep. 14, 2006 (JP) ..... 2006-249693
Jan. 19, 2007 (JP) ..... 2007-010348

(51) Int. Cl.
*G03G 15/08* (2006.01)

(52) U.S. Cl. ..... 399/286

(58) Field of Classification Search ..... 399/286; 521/86

See application file for complete search history.

(56) References Cited

U.S. PATENT DOCUMENTS

| | | | | |
|---|---|---|---|---|
| 4,863,646 | A * | 9/1989 | Watanabe et al. | 264/15 |
| 6,035,172 | A | 3/2000 | Mimura et al. | 399/286 |
| 6,471,628 | B1 * | 10/2002 | Hirayama | 492/56 |
| 6,810,225 | B2 | 10/2004 | Kitano et al. | 399/176 |
| 2001/0003757 | A1 * | 6/2001 | Sakata et al. | 521/137 |
| 2002/0091170 | A1 * | 7/2002 | Sakata et al. | 521/86 |
| 2003/0118372 | A1 | 6/2003 | Kitano et al. | 399/176 |

FOREIGN PATENT DOCUMENTS

| | | | |
|---|---|---|---|
| EP | 0911704 | | 4/1999 |
| EP | 0 926 571 | A2 | 6/1999 |
| EP | 1 014 212 | A1 | 6/2000 |
| JP | 9-087354 | | 3/1997 |
| JP | 10-186834 | | 7/1998 |
| JP | 2002214876 | A * | 7/2002 |
| JP | 2003-167398 | | 6/2003 |

OTHER PUBLICATIONS

Machine English translation with abstract of JP2002-214876.*
European Search Report issued in the counterpart Application No. 07115727.5 dated Dec. 28, 2009.
Official Action dated Dec. 23, 2010 in India Application No. 2044/CHE/2007.
Webster's Third New International Dictionary of the English Language, Unabridged, 1986, p. 2169.

* cited by examiner

*Primary Examiner* — David M Gray
*Assistant Examiner* — Billy J Lactaoen
(74) *Attorney, Agent, or Firm* — Fitzpatrick, Cella, Harper & Scinto

(57) ABSTRACT

A developing member is disclosed which can lessen the occurring of banding. The developing member has a shaft member, an elastic layer provided on the shaft member, and a resin layer provided on the surface, wherein the resin layer contains a urethane resin and a non-reactive silicone compound, and the non-reactive silicone compound has a polyether moiety whose total number of carbon atoms ranges from 3 to 9.

7 Claims, 2 Drawing Sheets

DEVELOPING MEMBER WITH URETHANE RESIN AND SILICONE SURFACE LAYER

BACKGROUND OF THE INVENTION

1. Field of the Invention

This invention relates to a developing member such as a developing roller used in, e.g., electrophotographic image forming apparatus such as copying machines and laser beam printers, and also relates to a developing assembly and an image forming apparatus which make use of the developing member.

2. Description of the Related Art

As one of development processes used in electrophotographic apparatus such as copying machines, laser beam printers, and receiving sets of facsimile machines, a pressure development process is available in which a non-magnetic toner-component developer is used and the developer is made to adhere to an electrostatic latent image held on a photosensitive drum, to render the latent image visible. This pressure development process is widely used because it requires no magnetic material, facilitates manufacture of simple and compact apparatus, and also facilitates preparation of color developers.

In the electrophotographic image forming apparatus employing such a pressure development process, a photosensitive drum being rotated is uniformly electrostatically charged by means of a charging member Then, the photosensitive drum is exposed to laser beams to form electrostatic latent images on the photosensitive drum. Next, a developer is fed to the electrostatic latent images by means of a developing assembly, and the electrostatic latent images are developed to form toner images. Thereafter, the toner images are transferred onto a transfer material (recording material). Finally, the toner images on the transfer material are, e.g., heated, and thereby fixed to the transfer material.

Meanwhile, the surface of the photosensitive drum from which the toner images have been transferred is destaticized, and then cleaned to remove any developer remaining on the surface. Thus, the surface is brought into the state of stand-by for further image formation.

The above developing assembly is provided with a developer container holding therein the developer, a developing roller which is so disposed as to close the opening of the developer container and partly stand bare to the outside of the developer container, and a developer feed roller which coats the surface of the developing roller with the developer.

The developing assembly is further provided with a developing blade which adjusts to a more uniform thin layer the developer with which the surface of the developing roller is kept coated, and is so set up that, as the developing roller is rotated, the thin-layer developer can be transported to the part where the developing roller stands bare.

The thin-layer developer adheres to the electrostatic latent images formed on the photosensitive drum being rotated that is disposed opposingly to the developing roller at its part where it stands bare, and renders the electrostatic latent images visible to form toner images on the photosensitive drum.

The developing roller used in such a developing assembly has a stated electrical resistance value, and is required not to change in electrical resistance and also required not to contaminate the photosensitive drum.

As a developing roller meeting such requirements, Japanese Patent No. 3186541 (Patent Registration 3186541) discloses a proposal of a conductive member making use of a urethane containing as a polyol component a poly(ether-polyol) in which ethylene oxide and propylene oxide have been added at random to glycerol.

Japanese Patent Application Laid-open No. 2003-167398 discloses that a urethane resin is preferable as a material for forming a surface layer of a conductive member used in the developing assembly of the electrophotographic image forming apparatus, but on the other hand has disadvantageous properties that it has a high tackiness and also may cause a large friction. Then, it discloses that adding a polysiloxane component to the urethane resin enables solution of the above problems on tackiness and frictional properties.

Now, the developer feed roller and the developing roller are, at the time of operation, mutually rotated and in contact with each other. Also, it follows that these continue to come into contact with each other at the same position over a long period time when the electrophotographic apparatus is continuously kept to stand unoperated over a long period time. If thereafter the process of forming electrophotographic images is carried out, line-shaped image non-uniformity (hereinafter "banding") may come about in the electrophotographic images formed. The banding may be remarkable especially in halftone images, and tends to occur as a result of leaving in an environment of high temperature and high humidity (e.g., temperature 40° C./humidity 95% RH) over a long period time.

The cause of occurrence of the banding is not necessarily clear. The present inventors presume it as stated below. That is, any components exuding out of the developer feed roller may adhere to the developing roller surface, where it follows that the developing roller surface differs in chemical composition from place to place. If electrophotographic images are formed using such a developing roller, the toner may come different in triboelectric charge quantity between areas to which the exuded components have adhered and areas not adhered, of the developing roller surface. In other words, the triboelectric charge quantity comes non-uniform. This is presumed to be one of the causes of occurrence of the banding.

SUMMARY OF THE INVENTION

An object of the present invention is to provide a developing roller which can lessen the occurring of the banding in electrophotographic images resulting from the exudation of components from the developer feed roller, even after the electrophotographic apparatus has continuously been kept to stand unoperated over a long period of time, and the developing roller and the developer feed roller have been brought into contact with each other in the quiescent condition.

Another object of the present invention is to provide a developing assembly which is applicable to high-speed and high-grade image quality electrophotographic apparatus, can lessen faulty electrophotographic images caused by the exudates out of the developer feed roller that have adhered to the developing roller surface. A further object of the present invention is to provide an electrophotographic image forming apparatus enabling high-grade electrophotographic image formation.

The present inventors have made extensive studies on a urethane resin layer to be provided at the surface of the developing roller, in order to lessen the deformation of the developing roller and the developer feed roller resulting from a long term contact therebetween, and lessen faulty electrophotographic images caused by the exudates out of the developer feed roller. In particular, on the basis of the disclosure in the above Japanese Patent Application Laid-open No. 2003-

167398, the present inventors have repeatedly made studies regarding a urethane resin layer containing a urethane resin and a polysiloxane.

As the result of the studies, the inventors have discovered that the above objects can well be achieved when the urethane resin layer contains a silicone compound having a polyether moiety consisting of an ether repeating unit whose total number of carbon atoms ranges from 3 to 9, and having no hydrogen atom reacting with an isocyanate group.

More specifically, it has been found that the developing member having as the surface layer the urethane resin layer containing the above-mentioned silicone compound can effectively lessen the occurring of the banding in electrophotographic images, even where the exudates out of the developer feed roller have adhered to the surface of the developing member. The reason why the developing member brings out such an effect is still under investigation. This is presumed to be due to the fact that the developing member cannot easily change in chargeability to the developer even where the exudates out of the developer feed roller have adhered to the surface thereof.

According to an aspect of the present invention, it provides a developing member which comprises a shaft member, an elastic layer provided on the shaft member, and a resin layer as a surface layer of the developing member, wherein; the resin layer contains a urethane resin and a non-reactive silicone compound, and the non-reactive silicone compound has a polyether moiety having an ether repeating unit whose total number of carbon atoms ranges from 3 to 9.

According to another aspect of the present invention, it provides a developing assembly which comprises the above developing member and a developer feed member kept in contact with the developing member.

According to still another aspect of the present invention, it provides an electrophotographic image forming apparatus which comprises an image bearing member for holding thereon an electrostatic latent image, a charging assembly for charging the image bearing member uniformly electrostatically, an exposure unit for forming the electrostatic latent image on the image bearing member charged uniformly electrostatically, a developing assembly for developing the electrostatic latent image with a developer to form a toner image, and a transfer assembly for transferring the toner image to a transfer material, wherein; the developing assembly is the developing assembly described above.

Further features of the present invention will become apparent from the following description of exemplary embodiments with reference to the accompanying drawings.

DESCRIPTION OF THE EMBODIMENTS

-Developing Member-

Figure 1:
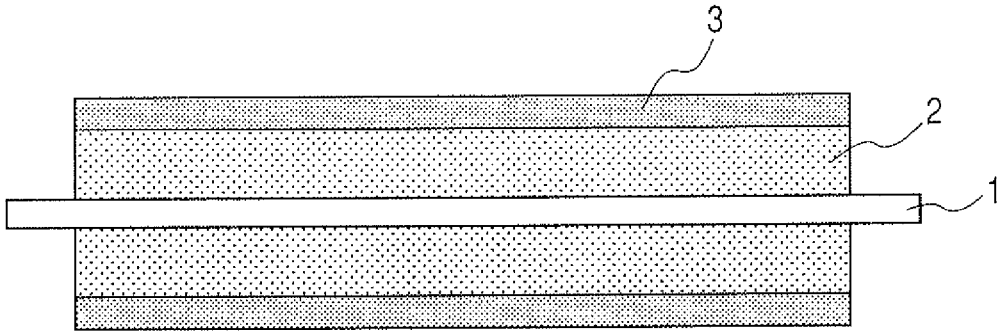
FIG. 1 is a perspective illustration showing an example of the developing roller according to the present invention.

The developing roller as the developing member according to an embodiment of the present invention has, as shown in FIG. 1, a shaft member 1, an elastic layer 2 provided on the shaft member 2, and as a surface layer a resin layer 3 including a urethane resin layer, provided on the elastic layer 2.

Re shaft member 1:

The shaft member 1 may preferably be one having strength high enough to function as a support member for the elastic layer and resin layer and electrical conductivity high enough to function as an electrode of the resin layer. The shaft member 1 may be made of a material including conductive materials as exemplified by metals or alloys, such as aluminum and stainless steel, iron having been plated with chromium or nickel, and synthetic resins having electrical conductivity. The shaft member may have outer diameter set in the range of, e.g., 4 mm or more to 10 mm or less.

Re elastic layer 2:

The elastic layer 2 may be either of a foam and a non-foam, and may consist of either of a single layer and a multiple layer. Such an elastic layer may preferably be one formed of an elastomer or resin having an appropriate hardness, such as ethylene-propylene-diene rubber, silicone rubber or urethane, as a base material, i.e., a chief constituent material, and containing a conductive material that provides electrical conductivity. The elastic layer 2 may preferably have a hardness of from 25 degrees or more to 75 degrees or less as Asker-C hardness. In particular, it may more preferably have a hardness of from 30 degrees or more to 70 degrees or less.

The elastic layer may preferably have a resistance range (volume resistivity) of from $10^3$ Ωcm or more to $10^{19}$ Ωcm or less. In particular, it may more preferably have a volume resistivity of from $10^4$ Ωcm or more to $10^3$ Ωcm or less.

Figure 3:
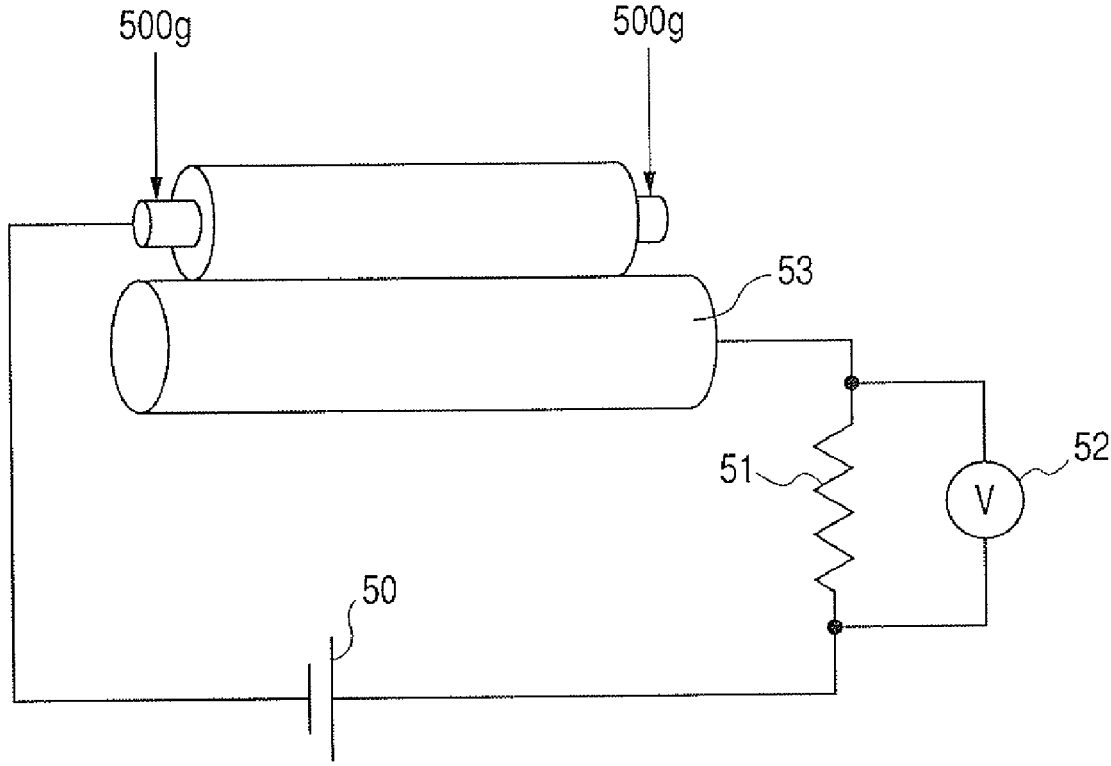
FIG. 3 illustrates how to measure electrical resistance of the developing roller.

With regard to the volume resistivity, the electrical resistance of the developing roller is measured with an electrical resistance measuring instrument shown in FIG. 3. A load is applied at 500 g each to the mandrel both end portions of the developing roller as shown by arrows in FIG. 3. This developing roller is pressed against a metallic drum 53, in the state of which it is rotated at the number of roller revolutions of 1 rps, during which a voltage of 50 V is applied from a power source 50. The voltages applied to a resistance 51 (10 kΩ) are read for 30 seconds on a voltmeter 52, and their average value is found to determine the value of roller electrical resistance.

The elastic layer may have layer thickness in the range of from 0.2 mm or more to 10.0 mm or less, and preferably from 1.0 mm or more to 5.0 mm or less.

To determine the layer thickness of the elastic layer, an elastic layer and a resin layer are, in the state of being stacked, cut from a roller on which the elastic layer and the resin layer have been formed, and the layer thicknesses of the elastic layer at its cross section at arbitrary 9 spots may be measured with a slide gauge and a videomicroscope (25-fold to 3,000-fold magnification) as appropriate. The average value of measurements obtained may be used as the layer thickness.

The base material of the elastic layer may specifically include the following: Polyurethane, natural rubber, butyl rubber, nitrile rubber, isoprene rubber, butadiene rubber, silicone rubber, styrene-butadiene rubber, ethylene-propylene rubber, ethylene-propylene-diene rubber, chloroprene rubber, and acrylic rubbers. Any of these may be used alone or in combination of two or more types. Of these, silicone rubber and ethylene-propylene-diene rubber are particularly preferred.

As the conductive material used to provide the elastic layer with electrical conductivity, it may be either of an electronically conductive material and an ionically conductive material. The electronically conductive material may include the following: Conductive carbons such as KETJEN BLACK EC and acetylene black; carbons for rubbers, such as SAF, ISAF, HAF, FEF, GPE, SRF, FT and MT; carbons for color inks, having been subjected to oxidation treatment; and besides metals such as copper, silver and germanium, and metal oxides of these.

Any of these conductive materials may be used alone or in combination of two or more types. Of these, carbon black such as the conductive carbon, the carbon for rubber or the carbon for color inks is preferred because the electrical conductivity can readily be controlled by its use in a small quantity.

The ionically conductive material may include the following: Inorganic compounds such as sodium perchlorate, lithium perchlorate, calcium perchlorate and lithium chloride; and organic compounds such as modified aliphatic dimethylammonium ethosulfate and stearylammonium acetate.

Any of these conductive materials may be used in a quantity necessary for the elastic layer to have an appropriate volume resistivity as stated above. The conductive material may be used in the range of from 0.5 part by mass or more to 50 parts by mass or less, and preferably in the range of from 1 part by mass or more to 30 parts by mass or less, based on 100 parts by mass of the base material.

Re resin layer 3:

The resin layer 3 is provided on the surface of the elastic layer 2 of the developing roller, and may be constituted of a single layer or a multiple layer. The resin layer may preferably be a non-foamed solid layer. This is because the shape of being foamed by no means appears on images, and there is no possibility of a lowering of strength required as the developing roller, which may come about when the resin layer is a foam.

The resin layer contains the urethane resin and the non-reactive silicone compound. The resin layer may preferably have a resistance range (volume resistivity) of from $10^3$ Ωcm or more to $10^{11}$ Ωcm or less, and more preferably from $10^4$ Ωcm or more to $10^{10}$ Ωcm or less. The resin layer may have layer thickness in the range of, e.g., from 0.5 μm or more to 200 μm or less, and preferably from 1.0 μm or more to 100 μm or less.

Re urethane resin:

The urethane resin of the above resin layer has a great ability to charge the developer triboelectricallly and also has wear resistance, and hence it is used as the base material of the surface layer of the developing roller. The urethane resin may be used as a sole resin component constituting the surface layer.

Such a urethane resin may include poly(ether urethane), poly(ester urethane), poly(carbonate urethane), poly(olefin urethane), and acryl-modified polyurethane. Any of these may be used alone or in combination of two or more types. In particular, the poly(ether urethane) is preferred because it has so high affinity for the polyether moiety of the non-reactive silicone compound as to keep the non-reactive silicone compound from exuding out of the resin layer and at the same time have high recovery properties against any strain. Hence, it can keep the strain from coming about that is due to contact with the blade or photosensitive drum, and can keep high-grade image formation performance from lowering. The poly(ether urethane) may specifically include those having at the ether moiety a repeating structural unit derived from any of the following alcohols: Ethylene glycol, propylene glycol, 1,4-butanediol, 1,5-pentanediol, neopentyl glycol, 1,6-hexanediol, 1,7-heptanediol, 1,8-octanediol, and 1,9-nonanediol.

Re non-reactive silicone compound:

The non-reactive silicone compound has a polyether moiety having an ether repeating unit whose total number of carbon atoms is 3, 4, 5, 6, 7, 8 or 9. The developing member whose surface layer comprises the above mentioned non-reactive silicone compound and urethane resin can lessen the influence of the exudates out of the developer feed roller, can lessen remarkable increase in concentration of the polyether group, and can lessen the occurring of the banding in the electrophotographic images. The non-reactive silicone compound can also have a good compatibility with the urethane resin as long as the total number of carbon atoms in the ether repeating unit is 9 or less, promising a superior moldability.

Specific examples of such a non-reactive silicone compound include straight-chain block polymers and branched graft polymers, composed of polyether and polysiloxane.

The polyether moiety in this non-reactive silicone compound may more preferably have an ether repeating unit whose total number of carbon atoms ranges from 4 to 6.

The polyether moiety may be of either a homopolymer type composed of one ether repeating unit whose total number of carbon atoms ranges from 3 to 9 and a copolymer type containing two or more of the same The copolymer type may be of either of a random copolymer type and a block copolymer type. The polyether moiety in this non-reactive silicone compound may contain, in addition to the ether repeating unit whose total number of carbon atoms ranges from 3 to 9, any other ether repeating unit, stated specifically, an ether repeating unit other than the ether repeating unit whose total number of carbon atoms ranges from 3 to 9. In such a case, both the ether repeating units may preferably be in a molar ratio in the range of (ether repeating unit whose total number of carbon atoms ranges from 3 to 9)/(other ether repeating unit) =95/5 to 70/30.

The polysiloxane in the non-reactive silicone compound may preferably be an organopolysiloxane not containing any active hydrogen, having an alkyl siloxane or the like as a unit. The organopolysiloxane may preferably be dimethyl polysiloxane. The silicone compound comes non-reactive as long as its polysiloxane is the organopolysiloxane and the silicone compound does not contain therein any substituent having active hydrogen, such as a hydroxyl group or an amino group having reactivity with the isocyanate group of the urethane resin. Such a non-reactive silicone compound by no means combines with the urethane resin, and can keep the movement of molecules from lowering in the non-reactive silicone compound because of its combination with the urethane resin.

In the non-reactive silicone compound, the polyether moiety and the polysiloxane moiety may be in a molar ratio (polysiloxane moiety/polyether moiety) of from 95/5 to 20/80. This is preferable because the effect of the present invention can well be brought out The non-reactive silicone compound may have weight average molecular weight (Mw) in the range of $3{,}000 \leqq Mw \leqq 20{,}000$. This makes it easier for the non-reactive silicone compound to exist on the developing roller surface to make the effect of the present invention brought out with greater ease.

Such a non-reactive silicone compound may include as preferred examples those represented by the following general formulas (A), (B), (C) and (D).

(A)

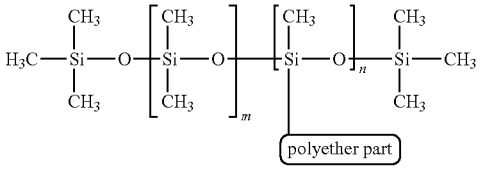

(B)

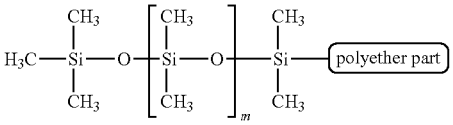

(C)

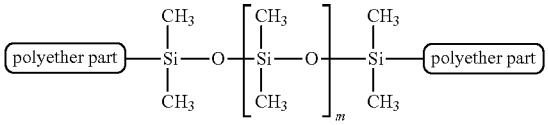

(D)

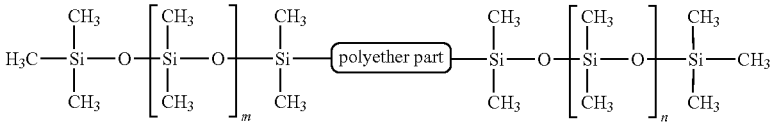

It is further preferable that the non-reactive silicone compound and the poly(ether urethane) contained in the urethane resin have a relationship represented by the following expression (1):

$$|x-y| \leqq 2 \quad (1)$$

In the above formula (1), x represents the total number of carbon atoms in the ether repeating unit of the polyether moiety in the non-reactive silicone compound, and y represents the total number of carbon atoms in the ether repeating unit of the poly(ether urethane).

That the non-reactive silicone compound and the poly (ether urethane) satisfy the above relationship makes intermolecular mutual action remarkably stronger at the polyether moieties between these compounds. As the result, the non-reactive silicone compound is strongly retained in the surface urethane resin layer as it maintains the movement of molecules. This also provides the developer with uniform triboelectric chargeability to make the developing roller greatly not easily affected by the exudates out of the developer feed roller.

The non-reactive silicone compound may preferably be in a content of from 0.1 part by mass or more to 20 parts by mass or less, and more preferably from 0.5 part by mass or more to 10 parts by mass or less, based on 100 parts by mass of the urethane resin contained in the resin layer. As long as the non-reactive silicone compound is in a content of 0.1 part by mass or more, images with a stable density can be obtained even where the electrophotographic apparatus is left in an environment of high temperature and high humidity over a long period time. As long as the non-reactive silicone compound is also in a content of 20 parts by mass or less, recovery properties against strain can sufficiently be achieved.

Molecular structure of the non-reactive silicone compound may be identified by pyrolytic GC/MS, NMR, IR, elementary analysis or the like. Its content may be ascertained from what has been extracted from the resin layer.

The non-reactive silicone compound may be prepared by introducing mutually reactive functional groups respectively into the polyether and the polysiloxane by a known synthesis method, and making them combine chemically. As examples of such a known synthesis method, the following methods are available: Addition reaction of a silicone oil having an Si—H group with a polyether having a carbon-carbon double bond at the terminal; and a method in which a silicone oil or polyether having an alcoholic hydroxyl group or carboxylic acid is subjected to dehydration condensation.

The resin layer may preferably contain a conductive agent so as to be provided with electrical conductivity. The conductive agent to be contained in the resin layer may specifically include the same electronically conductive material and ionically conductive material as the conductive materials used in the elastic layer described above. Such a conductive agent may be in a content of, e.g., from 1 part by mass or more to 50 parts by mass or less based on 100 parts by mass of the urethane resin of the resin layer.

The resin layer may also contain roughening particles in order to form unevenness on its surface.

Examples of such roughening particles include the following: Particles of rubbers such as EPDM, NBR, SBR, CR and silicone rubber; particles of elastomers such as polystyrene, polyolefin, polyvinyl chloride, polyurethane, polyester and polyamide type thermoplastic elastomers (TPE); and particles of resins such as PMMA, urethane resin, fluorine resin, silicone resin, phenol resin, naphthalene resin, furan resin, xylene resin, divinylbenzene polymer, styrene-divinylbenzene copolymer and polyacrylonitrile resin. Any of these types of particles may be used alone or in combination.

The developing roller on the surface of which the unevenness has been formed by such roughening particles may have a surface roughness Rz of from 1 μm or more to 15 μm or less. The value of surface roughness Rz of the developing roller may be the value measured by a method according to JIS B 0601:2001.

The developing member of the present invention may include as an example the developing roller shown in FIG. 1. The developing roller shown in FIG. 1 has the elastic layer 2 on the peripheral surface of a well electrically conductive shaft (the shaft member) 1 and the resin layer 3 on the surface. The developing roller of the present invention may be one provided with a functional layer as an upper layer or lower layer of the elastic layer, as long as it has the above resin layer on the surface. Such a functional layer may be incorporated with the non-reactive silicone compound described above.

To produce such a developing roller, the elastic layer may be formed on the peripheral surface of a shaft member coated appropriately with an adhesive To form the elastic layer, a method is available in which an elastic layer molding composition is casted into a cavity of a molding die previously provided therein with the shaft member, followed by, e.g., heating or irradiation with active energy rays to effect reaction curing or hardening to form the elastic layer integrally with the shaft member. The elastic layer may also be produced by cutting out a material in the stated shape such as a tubular shape and in the stated size by cutting or the like from a slab, or a block, separately molded using the elastic layer molding composition, and press-fitting the shaft member into this tubular material to form the elastic layer on the shaft member. The roller thus formed may further be subjected to cutting or sanding so as to be adjusted to have the stated outer diameter.

To form the resin layer on the elastic layer, a polyisocyanate and a polyol such as polyether-polyol which forms the desired urethane resin, additives such as the non-reactive silicone compound and the conductive agent, roughening particles and so forth may be kneaded. The kneading may be carried out by using a ball mill or the like, adding a curing agent and a curing catalyst to the above materials, and agitating these. The resin layer forming composition thus obtained may be made into the resin layer by the same method as the formation of the above elastic layer or otherwise by a method in which a coating of the composition is formed by spraying or dipping, followed by curing.

-Developing Assembly-

The developing assembly of the present invention is characterized by having the above developing member and a developer feed member, and is used in electrophotographic image forming apparatus such as copying machines, facsimile machines and laser beam printers.

In the developing assembly, the above developing roller is used as the developing member.

A developer feed roller may preferably be used as the developer feed member. Such a developer feed roller has a well conductive shaft (shaft member) and a foamed elastic layer formed on the peripheral surface of the shaft member. The foamed elastic layer may preferably contain a silicone compound having a polyether moiety containing an oxyethylene unit and an oxypropylene unit.

Examples of a base material for the foamed elastic layer of the developer feed roller, include polyurethane, nitrile rubber, ethylene-propylene rubber, ethylene-propylene-diene rubber, styrene-butadiene rubber, butadiene rubber, isoprene rubber, natural rubber, silicone rubber, acrylic rubber, chloroprene rubber, butyl rubber and epichlorohydrin rubber, and monomers which are raw materials for producing the afore-mentioned polyurethane and various rubber materials (such monomers are also termed as rubber materials in some cases) Any of these may be used alone or in combination of two or more types. Of these, polyurethane may preferably be used.

Such a polyurethane may be obtained using any of polyols such as polyether polyol, polyester polyol and polymer polyol, which are commonly used in producing soft polyurethane foams, and a polyisocyanate having a bifunctional or higher isocyanate group.

Stated specifically, the polyisocyanate may include the following: 2,4-Tolylene diisocyanate, 2,6-tolylene diisocyanate, orthotoluidiene diisocyanate, naphthylene diisocyanate, xylylene diisocyanate, 4,4'-diphenylmethane diisocyanate, carbodimide modified MDI, polymethylene polyphenyl isocyanate, and polymeric polyisocyanates. Any of these may by used alone or in combination of two or more types.

The silicone compound to be incorporated in the foamed elastic layer of the developer feed roller functions as a foam stabilizer. The form of combination of a polysiloxane moiety with the polyether moiety in the silicone compound may be a block polymer or a graft polymer. The polysiloxane moiety may preferably be an organopolysiloxane having an alkylsiloxane such as methylsiloxane as a unit. The polyether moiety may preferably contain an oxyethylene unit and an oxypropylene unit. This is preferable because the foam stabilization can be controlled with ease. The oxyethylene unit and oxypropylene unit in such a polyether moiety may preferably be in a molar ratio that the oxyethylene unit/the oxypropylene unit is from 20/80 to 80/20.

Additives such as a cross-linking agent, a blowing agent (such as water, a low-boiling matter or a gas), a surface-active agent, a catalyst, a conductivity-providing agent for providing a desired electrical conductivity and an antistatic agent may further be added to the foamed elastic layer.

The shaft member may specifically include members made of the same material, and having the same size, as those used in the developing roller described above.

There are no particular limitations on the outer diameter of the developer feed roller. It may have diameter which accords with its purposes, and may specifically have an outer diameter of from 10 mm or more to 20 mm or less.

There are no particular limitations on how to produce the developer feed roller, which may be produced by a suitable method selected from among known production methods. Stated specifically, a foamed elastic layer molding composition is prepared. The polyol and polyisocyanate that form the polyurethane, the silicone compound having a polysiloxane moiety and a polyether moiety, a blowing agent, and a catalyst, a cross-linking agent and a chain extender which are optionally used and other additives are homogeneously mixed to prepare the foamed elastic layer molding composition. This foamed elastic layer molding composition is casted into a cavity of a molding die previously provided therein with the shaft member, followed by heating or irradiation with active energy rays to effect blowing and curing or solidification to mold the foamed elastic layer integrally with the shaft member. Another method may also be used in which, from a slab, or a block, of a foamed elastic material formed by using the foamed elastic layer molding composition, a foamed elastic layer is cut out in the stated tubular shape and size by cutting or the like and then the shaft member is press-fitted into this tubular material to cover the surface of the shaft member with the foamed elastic layer. The roller formed may further be subjected to cutting or sanding so as to be adjusted to have the stated outer diameter.

Figure 2:
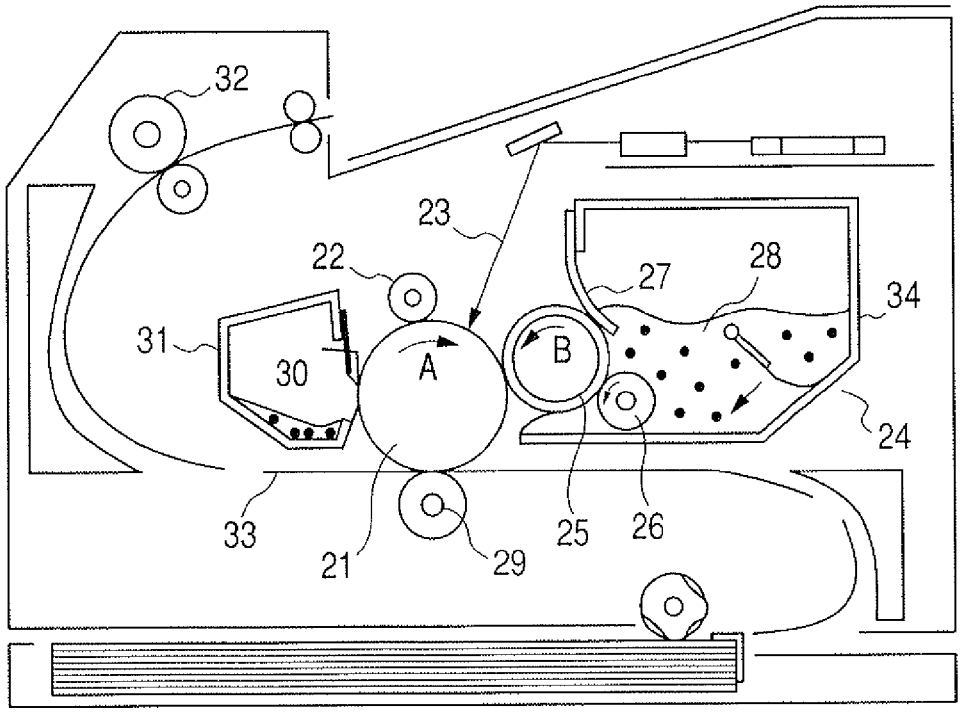
FIG. 2 is a schematic structural view showing an example of the electrophotographic image forming apparatus according to the present invention.

As the developing assembly according to the present invention, having such developing roller and developer feed roller, a developing assembly 24 shown in FIG. 2 may be given as an example. The developing assembly 24 shown in FIG. 2 is provided with a developer container 34 holding therein a non-magnetic developer 28 as a one-component developer, and a developing roller 25 as a developer carrying member, which is so disposed as to close the opening extending in the lengthwise direction of the developer container 34 and partly stand bare to the outside of the developer container. The developing roller is so provided as to be face to face in contact with a photosensitive drum 21 to have a contact width (a nip), at the part where the developing roller stands bare from the developer container. Inside the developer container 34, a developer feed roller 26 which feeds the developer to the developing roller 25 and also scrapes any developer remaining on the developing roller is rotatably provided in contact with the developing roller. On the downstream side of the developer feed roller in the rotational direction of the developing roller, a developing blade 27 is provided in contact with the developing roller, with which blade the developer on the developing roller is formed into a thin layer in a stated level as the developing roller is rotated. The thin-layer developer on the developing roller is transported to the part where the developing roller stands bare, and is fed to the photosensitive drum facing the developing roller at that part.

In such a developing assembly, as having the developing roller described previously, the feed roller components can be kept from exuding at the part of contact with the developer feed roller even after the apparatus has continuously been kept to stand unoperated over a long period time. Even if the feed roller components have come to exude, the exudates can be kept from adhering to the developing roller. Hence, the developer can uniformly be fed to the photosensitive drum, electrostatic latent images on the photosensitive drum can be developed at a uniform developer density, and the occurring of the banding can be lessened.

-Electrophotographic Image Forming Apparatus-

The electrophotographic image forming apparatus according to the present invention has an image bearing member for holding thereon electrostatic latent images. It further has a charging assembly for charging the image bearing member uniformly electrostatically, an exposure unit for forming the electrostatic latent images on the image bearing member thus charged uniformly, a developing assembly for developing the electrostatic latent images with a developer to form toner images, and a transfer assembly for transferring the toner images to a transfer material. This image forming apparatus is characterized in that the developing assembly is the developing assembly having the developing member described above.

As an example of the electrophotographic image forming apparatus of the present invention, it may include what is shown in FIG. 3 as a schematic structural view. In the electrophotographic image forming apparatus shown in FIG. 2, a photosensitive drum 21 as the image bearing member is provided rotatably in the direction of an arrow A. A charging member 22, an exposure means 23, a developing assembly 24, a transfer member 29, a cleaning member 30 and a fixing assembly 32 are provided around the photosensitive drum.

Using such an electrophotographic image forming apparatus, images are formed by a process as described below. On the surface of the photosensitive drum 21 charged uniformly electrostatically by means of the charging member 22, electrostatic latent images are formed by exposure to laser light of the exposure means 23. The electrostatic latent images are provided with a developer by means of the developing assembly 24, so that the latent images are developed and rendered visible as developer images. As development, reverse development is performed which forms the developer images at exposed areas. The developer images on the photosensitive drum 21 are transferred to paper 33 serving as the transfer material, by means of a transfer roller 29 serving as a transfer member. The paper 33 to which the developer images have been transferred is put to fix-processing by means of the fixing assembly 32, and then delivered out of the apparatus, thus the operation of printing is completed.

Meanwhile, a transfer residual developer having remained on the photosensitive drum 21 without being transferred therefrom is scraped off with the cleaning blade 30, which is a cleaning member for cleaning the photosensitive drum surface, and is received in a waste developer container 31. The photosensitive drum 21 thus cleaned is used in the image forming process that carries out the above operation repeatedly.

The developing assembly in the above electrophotographic image forming apparatus may be a developing assembly held in a process cartridge detachably mountable to the main body of the electrophotographic image forming apparatus.

The developing member according to the present invention enables the occurring of the banding to be lessened even after the apparatus has continuously been kept to stand unoperated over a long period time; the banding being caused by an influence of the exudates at the part of contact with the developer feed member. The developing assembly and electrophotographic image forming apparatus of the present invention also enable high-grade image formation, lessening the occurring of the banding due to the exuded components, even in electrophotographic apparatus required to be of high-speed and high-grade image quality.

EXAMPLES

The present invention is described below in greater detail by giving specific working examples in which the developing roller is used in a laser beam printer. The technical scope of the present invention is by no means limited to these.

-Examples and Synthesis Examples of Non-reactive Silicone Compound for Resin Layer- Non-reactive silicone compounds having polyether moieties having ether repeating units whose total number of carbon atoms ranges from 3 to 9 (Silicone Compounds No. 1, No. 2, No. 3, No. 4, No. 5, No. 6 and No. 7) were used in the working examples. Silicone Compound No. 8 was used in a comparative example.

Silicone Compound 1

TSF4460 (trade name; available from GE Toshiba Silicones) was used as a non-reactive silicone compound which had a polyether moiety having an ether repeating unit whose total number of carbon atoms was 3.

Silicone Compound 2

SILWET L-7210 (trade name; available from GE Toshiba Silicones; EO/PO=20/80 in molar ratio) was used as a non-reactive silicone compound which had a polyether moiety having an ether repeating unit whose total number of carbon atoms was 3, and another ether repeating unit whose total number of carbon atoms was 2

Silicone Compound 3

4.6 g of a polysiloxane compound (trade name: X22-162C; available from Shin-Etsu Chemical Co., Ltd.) and 0.003 mol of oxalyl dichloride (available from Aldrich Chemical Co., Inc.) were allowed to react in benzene at 40° C. for 5 hours to obtain an acid chloride.

2.0 g of the acid chloride obtained and 1.5 g of polypropylene glycol monobutyl ether (available from Aldrich Chemical Co., Inc.; Mn=1,000) were allowed to react in diethyl ether in the presence of pyridine in a small quantity and at room temperature for 24 hours. Thus, a non-reactive silicone compound was obtained in which the ether repeating unit had 3 carbon atoms. This non-reactive silicone compound had a weight average molecular weight (Mw) of 6,600.

Silicone Compound 4

10 g of polytetramethylene glycol (trade name: PTG1000SN; available from Hodogaya Chemical Co., Ltd.; Mn=1,000) and Jones reagent were allowed to react in acetone at 20° C. for 24 hours to obtain a polyether moiety raw material (a) Here, the Jones reagent was prepared by adding 0.022 mol of concentrated sulfuric acid to an aqueous 2 ml water solution of 0.014 mol of chromium(VI) oxide under ice cooling, followed by addition of 4 ml of water.

5.0 g of this raw material (a) and 0.014 mol of oxalyl dichloride (available from Aldrich Chemical Co., Inc.) were allowed to react in benzene at 40° C. for 5 hours to obtain an acid chloride. 2.5 g of the acid chloride obtained and 28 g of a polysiloxane compound (trade name: X22-17CDX; available from Shin-Etsu Chemical Co., Ltd.) were allowed to react in diethyl ether in the presence of pyridine in a small quantity and at room temperature for 24 hours to obtain a non-reactive silicone compound having the ether repeating unit whose total number of carbon atoms was 4. This non-reactive silicone compound had a weight average molecular weight (Mw) of 11,500.

Silicone Compound 5

1.0 mol of 1,5-pentanediol (available from Aldrich Chemical Co., Inc.) and 0.5 mol of 1,5-dibromopentane (available from Aldrich Chemical Co., Inc.) were allowed to react successively in THF (tetrahydrofuran) in the presence of 0.4 mol of sodium hydride and at room temperature for 24 hours to produce a polyol. 10 g of the polyol obtained and the same Jones reagent as the above were allowed to react in acetone at 20° C. for 24 hours to obtain a polyether moiety raw material (b).

5.0 g of this raw material (b) and 0.014 mol of oxalyl dichloride (available from Aldrich Chemical Co., Inc.) were allowed to react in benzene at 40° C. for 5 hours to obtain an acid chloride. 2.5 g of the acid chloride obtained and 28 g of a polysiloxane compound (trade name: X22-17CDX; available from Shin-Etsu Chemical Co., Ltd.) were allowed to react in diethyl ether in the presence of pyridine in a small quantity and at room temperature for 24 hours to obtain a non-reactive silicone compound having the ether repeating unit whose total number of carbon atoms was 5. This non-reactive silicone compound had a weight average molecular weight (Mw) of 12,100.

Silicone Compound 6

1.0 mol of 1,6-hexanediol (available from Aldrich Chemical Co., Inc.) and 0.5 mol of 1,6-dibromohexane (available from Aldrich Chemical Co., Inc.) were allowed to react successively in THF in the presence of 0.4 mol of sodium hydride and at room temperature for 24 hours to produce a polyol. 10 g of the polyol obtained and the same Jones reagent as the above were allowed to react in acetone at 20° C. for 24 hours to obtain a polyether moiety raw material (c).

5.0 g of this raw material (c) and 0.015 mol of oxalyl dichloride (available from Aldrich Chemical Co., Inc.) were allowed to react in benzene at 40° C. for 5 hours to obtain an acid chloride. 2.3 g of the acid chloride obtained and 28 g of a polysiloxane compound (trade name: X22-17CDX; available from Shin-Etsu Chemical Co., Ltd.) were allowed to react in diethyl ether in the presence of pyridine in a small quantity and at room temperature for 24 hours to obtain a non-reactive silicone compound having the ether repeating unit whose total number of carbon atoms was 6. This non-reactive silicone compound had a weight average molecular weight (Mw) of 11,000.

Silicone Compound 7

1.0 mol of 1,9-nonanediol (available from Aldrich Chemical Co., Inc.) and 0.5 mol of 1,9-dibromononane (available from Aldrich Chemical Co., Inc.) were allowed to react successively in THF in the presence of 0.4 mol of sodium hydride and at room temperature for 24 hours to produce a polyol. 10 g of the polyol obtained and the same Jones reagent as the above were allowed to react in acetone at 20° C. for 24 hours to obtain a polyether moiety raw material (d).

5.0 g of this raw material (d) and 0.017 mol of oxalyl dichloride (available from Aldrich Chemical Co., Inc.) were allowed to react in benzene at 40° C. for 5 hours to obtain an acid chloride. 2.0 g of the acid chloride obtained and 28 g of a polysiloxane compound (trade name: X22-17CDX; available from Shin-Etsu Chemical Co., Ltd.) were allowed to react in diethyl ether in the presence of pyridine in a small quantity and at room temperature for 24 hours. Thus, a non-reactive silicone compound was obtained which had the ether repeating unit whose total number of carbon atoms was 9. This non-reactive silicone compound had a weight average molecular weight (Mw) of 13,000.

Silicone Compound 8

4.6 g of a polysiloxane compound (trade name: X22-162C; available from Shin-Etsu Chemical Co., Ltd.) and 0.003 mol of oxalyl dichloride (available from Aldrich Chemical Co., Inc.) were allowed to react in benzene at 40° C. for 5 hours to obtain an acid chloride.

2.0 g of the acid chloride obtained and 1.2 g of polyethylene glycol monomethyl ether (available from Aldrich Chemical Co., Inc.; Mn=750) were allowed to react in diethyl ether in the presence of pyridine in a small quantity and at room temperature for 24 hours. Thus, a non-reactive silicone compound was obtained which had the ether repeating unit whose total number of carbon atoms was 2. This non-reactive silicone compound had a weight average molecular weight (Mw) of 6,100.

In the present EXAMPLES, in measuring the weight average molecular weight, a method of measuring molecular weight distribution by gel permeation chromatography (GPC) was used. The weight average molecular weight (Mw) of each chromatogram obtained by GPC was measured under the following conditions.

As a GPC instrument, HLC-8120GPC (trade name; manufactured by Tosoh Corporation) was used, having a refractive index detector. As columns, the following five columns were used in connection.

Guardcolumn (trade name: TSKguardcolumn Super H-L; available from Tosoh Corporation);

TSKgel Super H4000 (trade name; available from Tosoh Corporation);

TSKgel Super H3000 (trade name; available from Tosoh Corporation);

TSKgel Super H2000 (trade name; available from Tosoh Corporation); and

TSKgel Super H1000 (trade name; available from Tosoh Corporation).

As an eluent, toluene for high-speed liquid chromatography was used. Measurement was made in the following way: The temperature of an inlet was set at 40° C., the temperature of an oven at 40° C., and the temperature of the refractive index detector at 40° C. About 20 μl of a toluene sample solution of the non-reactive silicone compound, adjusted to a sample concentration of 0.3% by mass, was poured into the above columns, and was allowed to flow down at a flow rate of 0.5 ml/min. Further, polystyrene (trade name: EASICAL PS-2; available from Polymer Laboratories) was used to prepare a calibration curve.

Structures of the above Silicone Compounds No. 1 to No. 8 are shown below.

No. 1

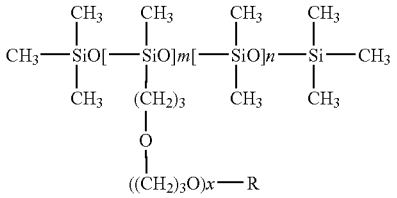

(In the above structural formula, m, n and x each represent an integer of 1 or more, and R represents an alkyl group.)

No. 2

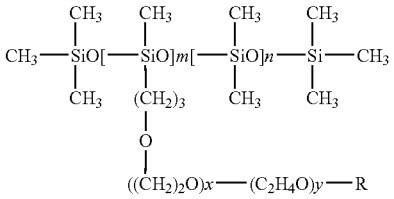

(In the above structural formula, m, n, x and y each represent an integer of 1 or more, and R represents an alkyl group.)

No. 3

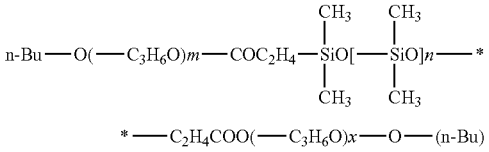

(In the above structural formula, m, n and x each represent an integer of 1 or more, and n-Bu represents a normal butyl group.)

No. 4

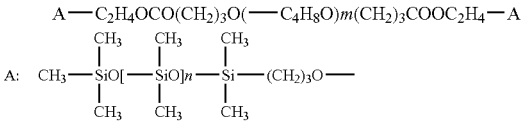

(In the above structural formula, m and n each represent an integer of 1 or more.)

No. 5

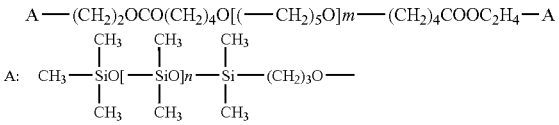

(In the above structural formula, m and n each represent an integer of 1 or more.)

No. 6

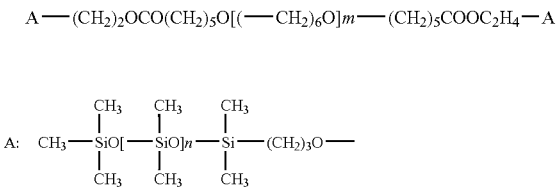

(In the above structural formula, m and n each represent an integer of 1 or more.)

No. 7

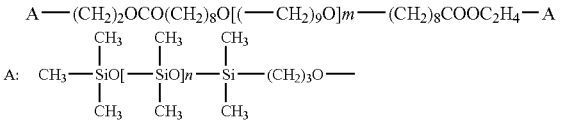

(In the above structural formula, m and n each represent an integer of 1 or more.)

No. 8

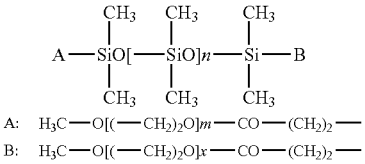

(In the above structural formula, m, n and x each represent an integer of 1 or more.)

Example 1

Formation of Conductive Elastic Layer:

A mandrel (shaft member) of 8 mm in outer diameter was placed in a cylindrical mold of 16 mm in inner diameter in such a way that these came concentric with each other. As a material for forming an elastic layer, liquid conductive silicone rubber (available from Dow Corning Toray Silicone Co., Ltd.; Asker-C hardness: 40 degrees; volume resistivity: $1\times10^7$ Ωcm) was casted into the mold. After casting, this was put into an oven of temperature 130° C. to carry out heat-molding for 20 minutes. The molded product obtained was demolded, and thereafter secondarily vulcanized for 4 hours in an oven of temperature 200° C. to form a conductive elastic layer of 4 mm in thickness on the shaft member.

Preparation of Resin Layer Forming Coating Material:

The following components (a1) and (a2) were stepwise mixed in a methyl ethyl ketone solvent to carry out reaction at 80° C. for 3 hours in an atmosphere of nitrogen to obtain a bifunctional polyether polyol prepolymer (1) having a weight average molecular weight (Mw) of 10,000 and a hydroxyl value of 18.2.

(a1) Polytetramethylene glycol (trade name: PTG100SN; available from Hodogaya Chemical Co., Ltd.; molecular weight Mn=1,000; f=2): 100 parts by mass.

(a2) Isocyanate (trade name: MILLIONATE MT; available from Nippon Polyurethane Industry Co., Ltd.): 18.7 parts by mass.

To a liquid mixture of 100 parts by mass of the polyether polyol prepolymer (1) synthesized as above and the following components (b1) and (b2), methyl ethyl ketone was added to prepare a resin layer forming raw-material solution having a solid content of 28% by mass.

(b1) Isocyanate (trade name: C2521; available from Nippon Polyurethane Industry Co., Ltd.): 85 parts by mass.

(b2) Non-reactive silicone compound (Silicone Compound 1): 5 parts by mass.

Next, the following components (c1) and (c2) were added to the above resin layer forming raw-material solution, followed by stirring and dispersion by means of a ball mill to prepare a resin layer forming coating material.

(c1) Carbon black (trade name: MA77; available from Mitsubishi Chemical Corporation): 20 parts by mass.

(c2) Acrylic resin particles (trade name: MX-1000; available from Soken Chemical & Engineering Co., Ltd.) 30 parts by mass.

Into this coating material, the mandrel having on its peripheral surface the conductive elastic layer molded previously was dipped to form a coating of 15 μm in thickness on the conductive elastic layer. Then, this coating was dried for 15 minutes in an oven of temperature 80° C., followed by curing for 4 hours in an oven of temperature 140° C. to obtain a developing roller having on its surface a resin layer.

Example 2

A developing roller was produced in the same manner as that in Example 1 except that 5 parts by mass of the non-reactive silicone compound (Silicone Compound 1) used in the resin layer forming coating material was changed for 0.08 part by mass of a non-reactive silicone compound (Silicone Compound 2).

Example 3

A developing roller was produced in the same manner as that in Example 1 except that 5 parts by mass of the non-reactive silicone compound (Silicone Compound 1) used in the resin layer forming coating material was changed for 0.1 part by mass of a non-reactive silicone compound (Silicone Compound 4).

Example 4

A developing roller was produced in the same manner as that in Example 1 except that 5 parts by mass of the non-reactive silicone compound (Silicone Compound 1) used in the resin layer forming coating material was changed for 20 parts by mass of a non-reactive silicone compound (Silicone Compound 4).

Example 5

A developing roller was produced in the same manner as that in Example 1 except that 5 parts by mass of the non-reactive silicone compound (Silicone Compound 1) used in the resin layer forming coating material was changed for 25 parts by mass of a non-reactive silicone compound (Silicone Compound 4).

Example 6

A developing roller was produced in the same manner as that in Example 1 except that 5 parts by mass of the non-reactive silicone compound (Silicone Compound 1) used in the resin layer forming coating material was changed for 10 parts by mass of a non-reactive silicone compound (Silicone Compound 5).

Example 7

A developing roller was produced in the same manner as that in Example 1 except that 5 parts by mass of the non-reactive silicone compound (Silicone Compound 1) used in the resin layer forming coating material was changed for 5 parts by mass of a non-reactive silicone compound (Silicone Compound 6).

Example 8

A developing roller was produced in the same manner as that in Example 1 except that 5 parts by mass of the non-reactive silicone compound (Silicone Compound 1) used in the resin layer forming coating material was changed for 5 parts by mass of a non-reactive silicone compound (Silicone Compound 7)

Example 9

A developing roller was produced in the same manner as that in Example 1 except that 5 parts by mass of the non-reactive silicone compound (Silicone Compound 1) used in the resin layer forming coating material was changed for 3 parts by mass of a non-reactive silicone compound (Silicone Compound 3).

Comparative Example 1

A developing roller was produced in the same manner as that in Example 1 except that 5 parts by mass of the non-reactive silicone compound (Silicone Compound 1) used in the resin layer forming coating material was not used.

Comparative Example 2

A developing roller was produced in the same manner as that in Example 1 except that 5 parts by mass of the non-reactive silicone compound (Silicone Compound 1) used in the resin layer forming coating material was changed for 3 parts by mass of dimethylsilicone oil (trade name: SH200; available from Dow Corning Toray Silicone Co., Ltd).

Comparative Example 3

The following materials were mixed, and the mixture obtained was diluted with methanol, followed by stirring and dispersion by means of a ball mill to prepare a coating material.

Resol type phenolic resin (trade name: J-325; available from Dainippon Ink & Chemicals, Incorporated): 100 parts by mass.

Carbon black (trade name: MA77; available from Mitsubishi Chemical Corporation): 12 parts by mass.

Non-reactive silicone compound (Silicone Compound 8): 10 parts by mass.

This coating material was applied by dipping on the same elastic layer molded in the same way as that in Example 1, so as to have a layer thickness of 15 μm in thickness, followed by heating for 40 minutes in an oven of temperature 150° C. to effect curing to form a resin layer to obtain a developing roller.

-Production of Developer Feed Roller-

The following materials were previously mixed

Polyol (trade name: FA908; available from Sanyo Chemical Industries, Ltd.): 90 parts by mass.

Polyol (trade name: POP34-28; available from Sanyo Chemical Industries, Ltd.): 10 parts by mass.

Tertiary-amine catalyst (trade name: TOYOCAT-ET; available from Tosoh Corporation): 0.1 part by mass.

Tertiary-amine catalyst (trade name: TOYOCAT-L33; available from Tosoh Corporation): 0.5 part by mass.

Water (blowing agent): 2.5 parts by mass.

Polysiloxane-polyether copolymer (trade name: SH190; available from Dow Corning Toray Silicone Co., Ltd.): 1 part by mass.

Thereafter, to the resultant mixture, 24 parts by mass of a polyisocyanate (trade name: COLONATE 1021; available from Nippon Polyurethane Industry Co., Ltd.; NCO %=45) was added, and these were mixed and stirred. Next, using a molding die, a 4.5 mm thick, foamed elastic layer composed of polyurethane sponge was formed around a mandrel of 5 mm in outer diameter under conditions of 70° C. for 20 minutes to produce a developer feed roller.

-Image Evaluation-

Evaluation on banding at the part of contact between developing roller and developer feed roller:

The developing roller and the developer feed roller were set in an electrophotographic process cartridge used for a color laser printer. This cartridge was left for 30 days in a normal-temperature and normal-humidity environment (temperature 23° C./humidity 55% RH). Thereafter, images were actually reproduced using a color laser printer (COLOR LASER JET 4700; manufactured by Hewlett-Packard Co.), and then visually observed to make image evaluation (Banding A) according to the criteria shown below. A magenta developer loaded in a magenta printing cartridge of COLOR LASER JET 4700 was used as the developer as it was. The results are shown in Table 1.

A: No banding is seen.

B: Banding is seen but very slightly at most.

C: Banding is slightly seen. No problem in practical use.

The process cartridge in which the developing roller and the developer feed roller were set was left for 30 days in a high-temperature and high-humidity environment (temperature 40° C./humidity 95% RH) to make image evaluation (Banding B) in the same way. The results are shown in Table 1.

-Image Density Evaluation-

The developing roller and the developer feed roller were set in an electrophotographic process cartridge used for a color laser printer. This cartridge was left for 30 days in a high-temperature and high-humidity environment (temperature 40° C./humidity 95% RH). Thereafter, solid black images were actually reproduced using a color laser printer (trade name: COLOR LASER JET 4700; manufactured by Hewlett-Packard Co.). A magenta developer loaded in a magenta printing cartridge of the color laser printer was used as the developer as it was. Densities of solid black areas were measured with a reflection densitometer (trade name: RD918; manufactured by Macbeth Co.) at nine spots, and their average value was regarded as image density. Usually, it is preferable as high-grade images that solid image density at the initial stage is 1.3 or more, and is more preferable that it is 1.35 or more. The results are shown in

TABLE 1

| | x | \|x − y\| | Amount (pbm) | Banding A | Banding B | Image density |
|---|---|---|---|---|---|---|
| Example: | | | | | | |
| 1 | 3 | 1 | 5 | A | A | 1.36 |
| 2 | 2, 3 | 1, 2 | 0.08 | A | B | 1.30 |
| 3 | 4 | 0 | 0.1 | A | A | 1.35 |
| 4 | 4 | 0 | 20 | A | A | 1.38 |
| 5 | 4 | 0 | 25 | A | A | 1.38 |
| 6 | 5 | 1 | 10 | A | A | 1.37 |
| 7 | 6 | 2 | 5 | A | A | 1.36 |
| 8 | 9 | 5 | 5 | A | B | 1.35 |
| 9 | 3 | 1 | 3 | A | A | 1.35 |
| Comparative Example: | | | | | | |
| 1 | — | — | — | B | C | 1.33 |
| 2 | — | — | 3 | B | C | 1.28 |
| 3 | 2 | — | 10 | C | C | 1.28 |

(pbm): (part(s) by mass)

x: The number of carbon atoms in the ether repeating unit of the polyether moiety in the non-reactive silicone compound.

y: The number of carbon atoms in the ether repeating unit of the poly(ether urethane) in the resin layer.

As is clear from the above results, the occurring of the banding can be lessened when the developing roller is used in which the resin layer contains the non-reactive silicone compound having the polyether moiety and the polyether moiety of the non-reactive silicone compound has the ether repeating unit having 3 to 9 carbon atoms.

The banding may also not come about in halftone images even when the apparatus is left in a high-temperature and high-humidity environment in the state the developing roller is kept in contact with the developer feed roller at the same position over a long period time. Thus, high-grade images can be obtained. At the same time, high-grade images with a stable density can be obtained.

Incidentally, in the claims in the present application and in the specification of the present application, where the range of numerical values is specified by "... or more to ... or less" and where it is specified by "... to ...", the lower-limit numerical value and the upper-limit numerical value are included in such numerical ranges.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-249693, filed Sep. 14, 2006, and No. 2007-010348, filed Jan. 19, 2007, which are hereby incorporated by reference herein in their entirety.

What is claimed is:

1. A developing member which comprises a shaft member, an elastic layer provided on the shaft member, and a resin layer as a surface layer of the developing member, wherein;

the resin layer is a non-foamed solid layer and contains a urethane resin and a non-reactive silicone compound; and the non-reactive silicone compound has a polyether moiety having an ether repeating unit in the molecule thereof and total number of carbon atoms in the ether repeating unit ranges from 3 to 9.

2. The developing member according to claim 1, wherein the urethane resin of the resin layer is poly(ether urethane).

3. The developing member according to claim 2, wherein the non-reactive silicone compound and the poly(ether urethane) satisfy the following expression (1):

$$|x-y| \leqq 2 \quad (1)$$

wherein x represents the total number of carbon atoms in the ether repeating unit in the polyether moiety of the non-reactive silicone compound, and y represents the total number of carbon atoms in the ether repeating unit in the poly(ether urethane).

4. The developing member according to claim 1, wherein the resin layer contains the non-reactive silicone compound in an amount of from 0.1 part by mass or more to 20 parts by mass or less based on 100 parts by mass of the urethane resin.

5. A developing assembly which comprises the developing member according to claim 1, and a developer feed member kept in contact with the developing member.

6. The developing assembly according to claim 5, wherein the developer feed member comprises a shaft member and a foamed elastic layer provided on the shaft member as a surface layer of the developer feed member, and the foamed elastic layer contains a silicone compound having a polyether moiety containing an oxyethylene unit and an oxypropylene unit.

7. An electrophotographic image forming apparatus which comprises:

an image bearing member for holding thereon an electrostatic latent image, a charging assembly for charging the image bearing member uniformly electrostatically, an exposure unit for forming the electrostatic latent image on the image bearing member charged uniformly electrostatically, a developing assembly for developing the electrostatic latent image with a developer to form a toner image, and a transfer assembly for transferring the toner image to a transfer material, wherein the developing assembly is the developing assembly according to claim 5.

* * * * *